US008808051B2

(12) United States Patent
Wei

(10) Patent No.: US 8,808,051 B2
(45) Date of Patent: Aug. 19, 2014

(54) COUPLING STRUCTURE

(75) Inventor: Chih Shing Wei, Lattingtown, NY (US)

(73) Assignee: Grace-Comp Systems, Ltd., Lattingtown, NY (US)

( * ) Notice: Subject to any disclaimer, the term of this patent is extended or adjusted under 35 U.S.C. 154(b) by 138 days.

(21) Appl. No.: 13/457,611

(22) Filed: Apr. 27, 2012

(65) Prior Publication Data

US 2012/0282841 A1 Nov. 8, 2012

(30) Foreign Application Priority Data

May 4, 2011 (TW) ..... 100115579 A

(51) Int. Cl.
*A63H 1/18* (2006.01)

(52) U.S. Cl.
USPC ..... 446/118

(58) Field of Classification Search
CPC ..... A63H 33/06; A63F 2003/00731
USPC ..... 446/118
See application file for complete search history.

(56) References Cited

U.S. PATENT DOCUMENTS 7,546,703 B2 * 6/2009 Johnske et al. ..... 40/539
7,677,567 B2 * 3/2010 Chen ..... 273/157 R
7,797,890 B2 * 9/2010 Thrush et al. ..... 52/177
7,802,410 B2 * 9/2010 Breaz ..... 52/503
7,914,287 B2 * 3/2011 Nguyen ..... 434/204
7,942,717 B2 * 5/2011 Chou ..... 446/91
8,074,988 B2 * 12/2011 Sakdinan ..... 273/157 R
8,079,890 B2 * 12/2011 Seligman ..... 446/124
8,105,127 B2 * 1/2012 Heston ..... 446/85
8,142,252 B1 * 3/2012 Krull ..... 446/268
8,408,962 B2 * 4/2013 Sambenedetto ..... 446/85
8,414,602 B2 * 4/2013 Selis ..... 606/151
8,424,258 B2 * 4/2013 Modica et al. ..... 52/285.4
8,475,226 B2 * 7/2013 Comfort ..... 446/168
8,495,850 B1 * 7/2013 Lin ..... 52/592.6
8,540,545 B2 * 9/2013 Leicht ..... 446/118
2006/0276100 A1 * 12/2006 Glickman ..... 446/118
2008/0032586 A1 * 2/2008 Dyer ..... 446/85
2011/0124263 A1 * 5/2011 Cheng ..... 446/118

* cited by examiner

*Primary Examiner* — Kurt Fernstrom
*Assistant Examiner* — Dolores Collins

(57) ABSTRACT

A coupling structure includes a main board and at least one coupler detachably connected to the main board. The main board has at least one coupling trough defined in the main board, a first abutting element defined in a side face of the at least one coupling trough and a support beam formed adjacent to the at least one coupling trough. The at least one coupler has at least one first arm and at least one second arm to receivably contain therebetween the support beam. The at least one first arm has a second abutting element formed at a distal end thereof to correspond to and abut a periphery of the first abutting element so that engagement between the main board and the at least one coupler is detachably secured.

17 Claims, 20 Drawing Sheets

COUPLING STRUCTURE

FIELD OF THE INVENTION

The invention relates to a coupling structure, and more particularly to a coupling structure for construction sets.

BACKGROUND OF THE INVENTION

In order to inspire and educate children, parents often use construction or block building sets to introduce the concepts of space, logic, and creativity to the youths. During the process of building and assembling, a child can create various types of objects such as airplane, tanks, cars, and other toy structures. Thus the child's creative mind is gradually developed and his or her curiosity satisfied.

Although existing construction or block building sets have inspired so many, they generally exhibit a structural size and strength limitation caused by the relatively weak coupling arisen from a linear slide-on or snap-on action between the construction parts.

Improving the coupling or connection structure between two adjacent construction parts or units would result in stronger and more versatile construction sets.

SUMMARY OF THE INVENTION

The primary objective of the present invention is to provide an improved coupling structure for use in construction sets or the like.

Still another objective of the present invention is to provide a coupling structure having a main board and at least one coupler detachably connected to the main board. The main board has at least one coupling trough defined therein and a support beam formed adjacent to the at least one coupling trough. The at least one coupler has at least one first arm and at least one second arm both integrally formed and extending out in different directions to define a receiving space therebetween.

Another objective of the present invention is that the at least one coupling trough of the main board is composed of a through-hole defined near a peripheral edge of the main board and the support beam is formed between the at least one coupling trough and the peripheral edge of the main board.

Another objective of the present invention is that the main board further has a first abutting element formed on a sidewall of the at least one coupling trough.

Still another objective of the present invention is that the at least one first arm has a length longer than that of the at least one second arm and the support beam is substantially surrounded by the at least one first arm and the at least one second arm.

Another objective of the present invention is that the support beam has a thickness thinner than that of the main board.

A further objective of the present invention is that the at least one coupler has a second abutting element formed on a distal end of the at least one first arm so that after the at least one first arm is extended into the at least one coupling trough, the second abutting element is able to abut a periphery of the first abutting element to secure the connection between the main board and the at least one coupler.

Another objective of the present invention is that the support beam may define a first alignment element and the receiving space may define a second alignment element such that the first alignment element aligns with the second alignment element when the main board is coupled with the at least one coupler.

Another objective of the present invention is that an outer sidewall of the support beam is of a different length than an inner sidewall of the support beam.

Still a further objective of the present invention is that the support beam has a rounded cross section.

Another objective of the present invention is that the at least one coupling trough is composed of a coupling recess defined between the main board and the support beam.

Another objective of the present invention is that the at least one coupler may have at least three first arms and at least three second arms each paired with one of the at least three first arms.

DETAILED DESCRIPTION OF THE INVENTION

The present invention now will be described more fully hereinafter with reference to the accompanying drawings, in which some, but not all embodiments of the invention are shown. It is learned that after the description, any variation, modification or the like to the structure and the embodiments of the present invention is readily understood by any person skilled in the art. Thus, the following description is only for illustrative purpose only and does not, in any way, try to limit the scope of the present invention.

Figure 1:
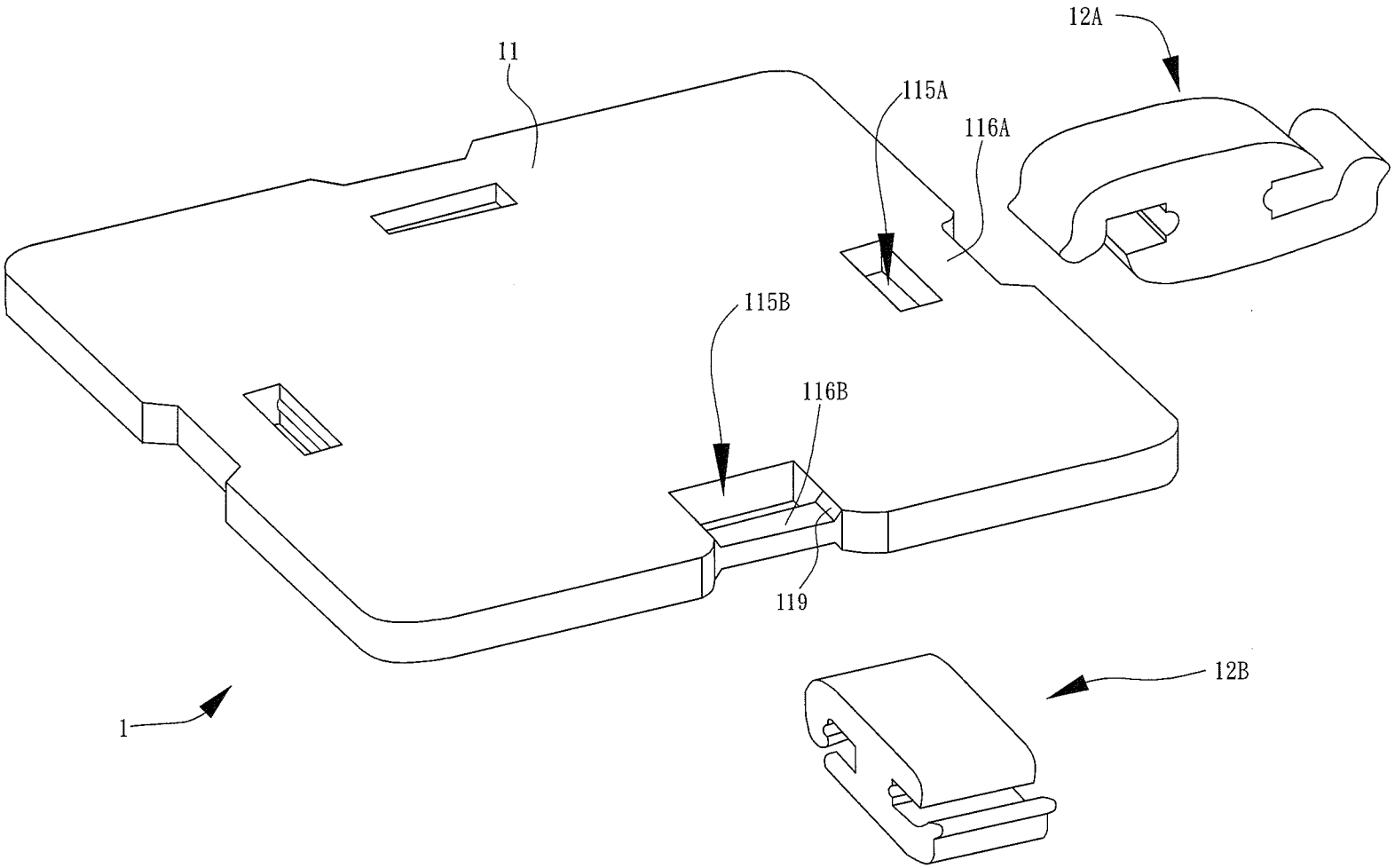
FIG. 1 is an exploded perspective view showing a coupling structure constructed in accordance with the present invention.
Figure 2:
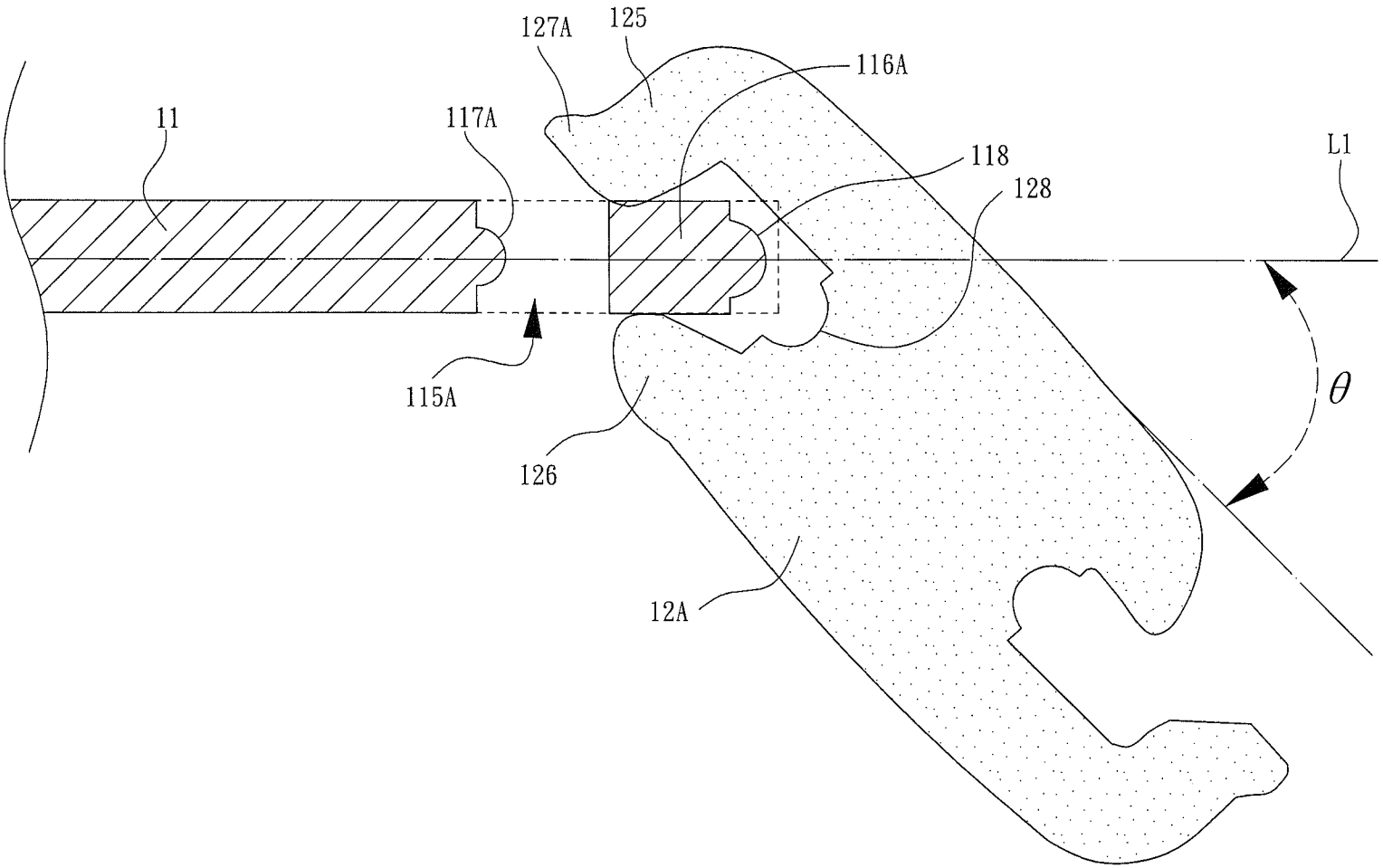
FIG. 2 is a cross sectional view showing the assembly between a main board and a coupler.
Figure 3:
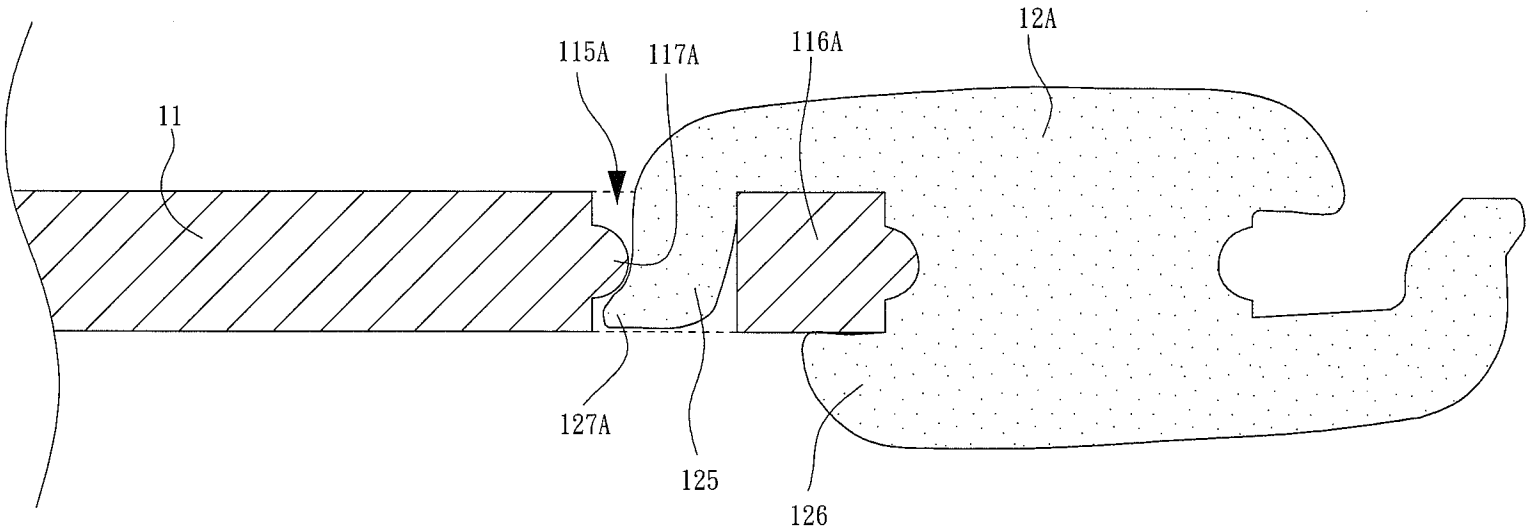
FIG. 3 is a cross sectional view showing the coupling between a main board and a coupler of the present invention.

With reference to FIGS. 1, 2 and 3 of the first preferred embodiment of the present invention, it is noted that a coupling structure 1 constructed in accordance with the present invention is composed of a main board 11 and at least one coupler 12A detachably connected to the main board 11. A second coupler 12B may also be provided to detachably connect to the main board 11.

The main board 11 is provided with at least one coupling trough 115A defined therein and a support beam 116A integrally formed with the main board 11, adjacent to the at least one coupling trough 115A. A second coupling trough 115B may also be defined in the main board 11 and a second support beam 116B may also be integrally formed with the main board 11. The main board 11 further may have a first abutting element 117A formed in an inner face defining the at least one coupling trough 115A and a first alignment element 118, shown as a boss in FIG. 2, formed on an outer periphery of the support beam 116A.

The coupler 12A has a body (not numbered), at least one first arm 125 integrally extended from the body and at least one second arm 126 also integrally extended from the body and in a direction different from that of the at least one first arm 125 such that a receiving space (not numbered) is defined between the at least one first arm 125 and the at least one second arm 126. In addition, the coupler 12A may have a second alignment element 128, shown as a recess in FIG. 2, defined on a periphery of the receiving space to receive therein and align with the first alignment element 118. A longitudinal line (L1) is defined to divide the main board 11 into two halves and the two halves of the main board 11 are symmetrical to one another. The greatest advantage of this symmetry is that the at least one first arm 125 is able to connect to the coupling trough 115A in either direction, i.e. from top or bottom of the main board 11.

From the depiction of the accompanying drawings, it is noted that the coupling trough 115A may be composed of a through-hole. When the main board 11 is to be connected to the coupler 12A, the coupler 12A is inclined at an angle θ relative to the main board 11 and positioned leftward with the at least one first arm 125 ready to extend into the coupling trough 115A from the top face of the support beam 116A while the at least one second arm 126 engages with the bottom face of the support beam 116A, as shown in FIG. 2.

Using the distal end of the second arm 126 as a support, a counterclockwise torque is applied to the coupler 12A to allow the first arm 125 to preferably extend into the coupling trough 115A. In order to securely engage with the main board 11, the coupler 12A further has a second abutting element 127A, i.e., a protrusion in this embodiment, formed on a distal end of the first arm 125 such that after the first arm 125 is extended into the coupling trough 115A, the second abutting element 127A abuts a bottom periphery of the first abutting element 117A, as shown in FIG. 3. Furthermore, the first alignment element 118 is received in and aligned with the second alignment element 128 of the coupler 12A. In this embodiment, it is learned that the first abutting element 117A and the first alignment element 118 are formed as bosses to respectively correspond to the second abutting element 127A, a protrusion, and the second alignment element 128, a recess. A further feature of this design is that the first arm 125 of the coupler 12A is made of a resilient material and has a length longer than that of the second arm 126 which is also made of a resilient material. Due to the resilience of the first arm 125 and the second arm 126, while the coupler 12A is to be engaged with the main board 11, the counterclockwise torque applied to the coupler 12A will force the first arm 125 together with the second abutting element 127A, which are originally hindered by the first abutting element 117A, to deform slightly such that the first arm 125 as well as the second abutting element 127A are able to pass over the first abutting element 117A, to allow the second abutting element 127A to eventually abut a bottom periphery of the first abutting element 117A.

Still another feature of the present preferred embodiment is that the receiving space defined between the first arm 125 and the second arm 126 is an open space so that the support beam 116A is able to extend into the receiving space. To further secure the engagement between the main board 11 and the coupler 12A, at least two opposite sidewalls defining the receiving space are made to conform to the top and bottom faces of the support beam 116A such that after the support beam 116A is entirely received in the receiving space, the two opposite sidewalls of the receiving space are in engagement with the top and bottom faces of the support beam 116A, as shown in FIG. 3.

When disengagement between the main board 11 and the at least one coupler 12A is necessary, the at least one second arm 126 is used as a support to rotate the at least one coupler 12A clockwise. Again, due to the resilience of the at least one first arm 125, the torque applied to rotate the at least one coupler 12A forces the at least one first arm 125 to distort, which allows the at least one first arm 125 as well as the second abutting element 127A to pass over the first abutting element 117A and then the at least one coupler 12A is free from engagement with the main board 11.

There may be provided with a second coupler 12B to correspond to the coupling trough 115B of the main board 11. The coupler 12A and the coupler 12B are structurally identical. However, the support beam 116B defined adjacent to the coupling trough 115B has a thickness thinner than that of the main board 11 such that inclined surfaces 119 are formed on two opposite sides of the coupling trough 115B, where the support beam 116B meets the main board 11. With the provision of the inclined surfaces 119, the engagement between the main board 11 and the coupler 12B is enhanced.

Figure 4:
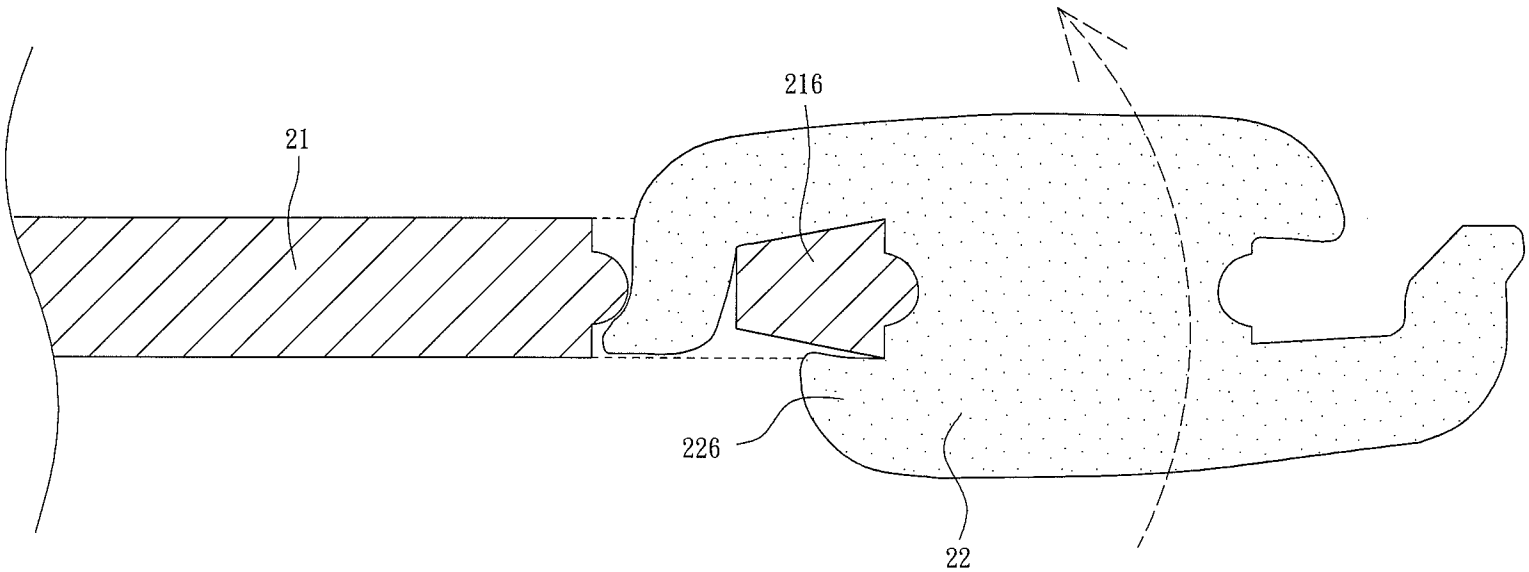
FIG. 4 is a cross sectional view showing a second embodiment of the present invention.
Figure 5:
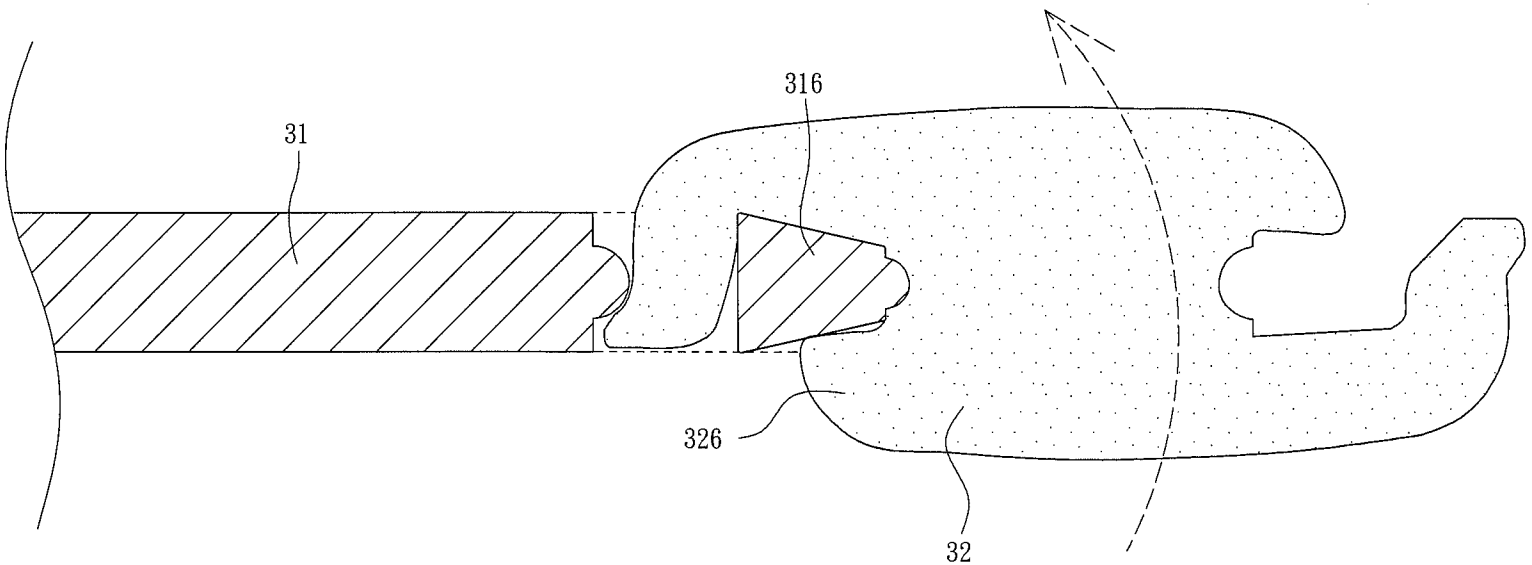
FIG. 5 is a cross sectional view showing a third embodiment of the present invention.

With reference to FIGS. 4 and 5, it is noted that the support beam 216, 316 is now trapezoidal in cross section. The structure shown in FIG. 4 indicates that an outer sidewall on the right side of the support beam 216 is longer than an inner sidewall on the left side, which lessens the tendency of overly rotating the coupler 22 counterclockwise during engagement. The structure shown in FIG. 5 indicates that the outer sidewall on the right side of the support beam 316 is shorter than the inner sidewall on the left side, which facilitates the rotating of the coupler 32 counterclockwise.

Figure 6:
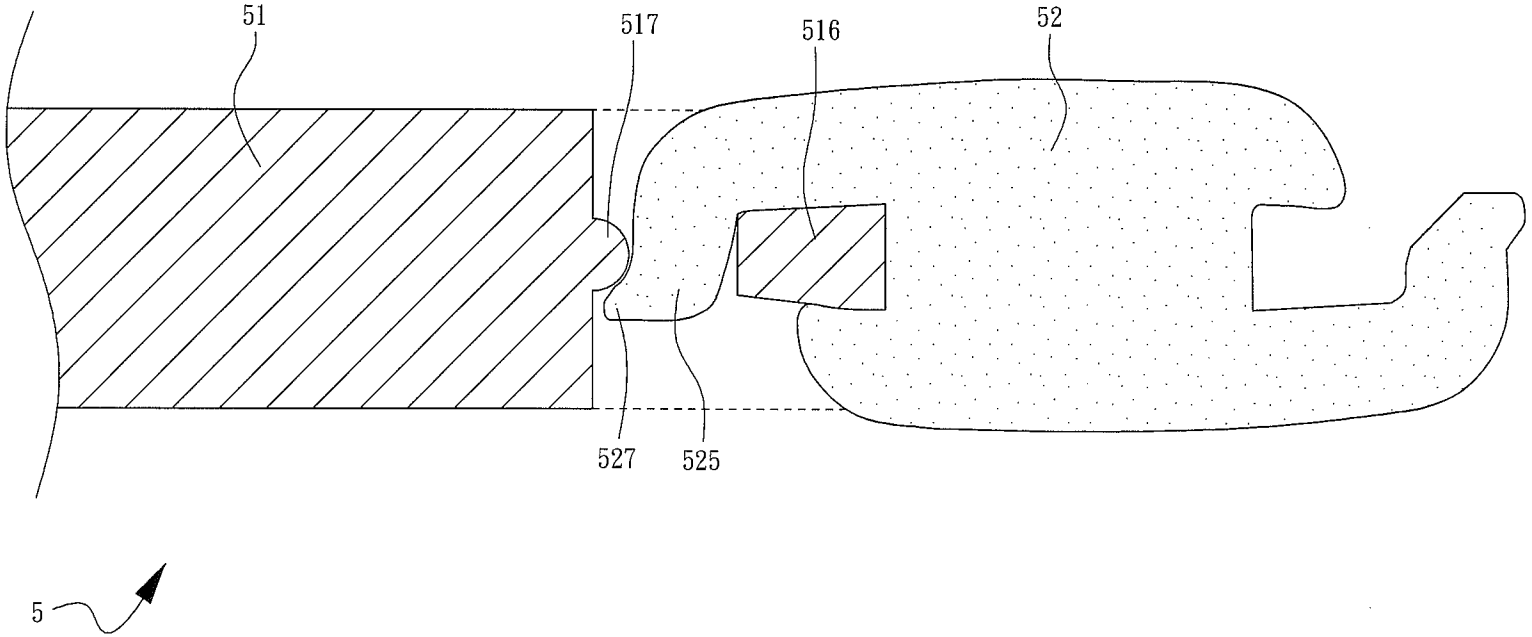
FIG. 6 is a cross sectional view showing a fourth embodiment of the present invention.

With reference to FIG. 6, it is noted that the embodiment indicates that the support beam 516 has a thickness thinner than that of the main board 51. Further, the second abutting element 527 at the distal end of the first arm 525 is abutted against the bottom periphery of the first abutting element 517. It is also noted that this embodiment does not feature the first and second alignment elements 118, 128 shown in FIG. 2.

Figure 7:
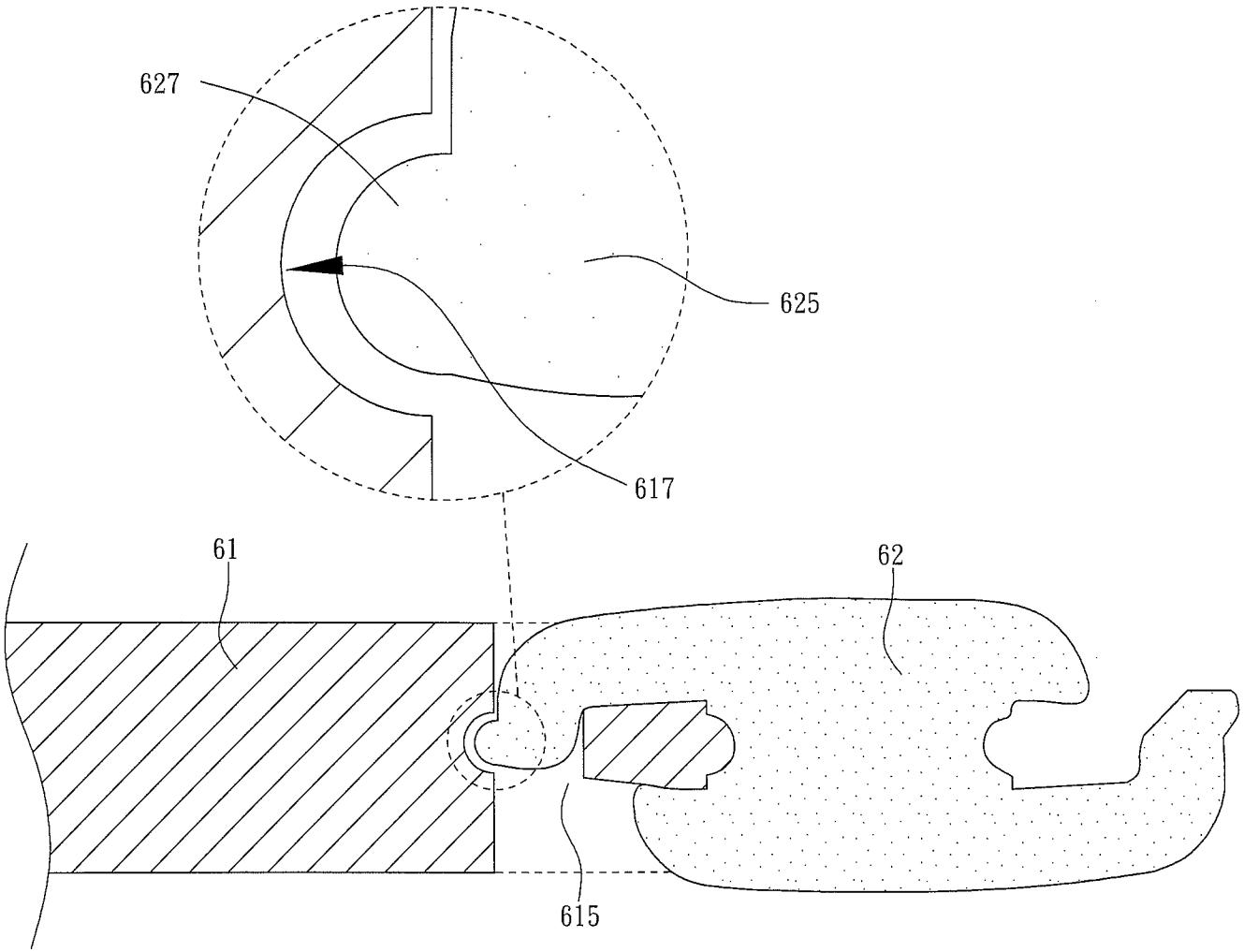
FIG. 7 is a cross sectional view showing a fifth embodiment of the present invention.

With reference to FIG. 7, it is noted that the first abutting element 617 is now composed of a recess defined in a side face defining the coupling trough 615. The second abutting element 627, a protrusion, formed at the distal end of the first arm 625 is received in the recess to secure the engagement between the main board 61 and the coupler 62.

Figure 8:
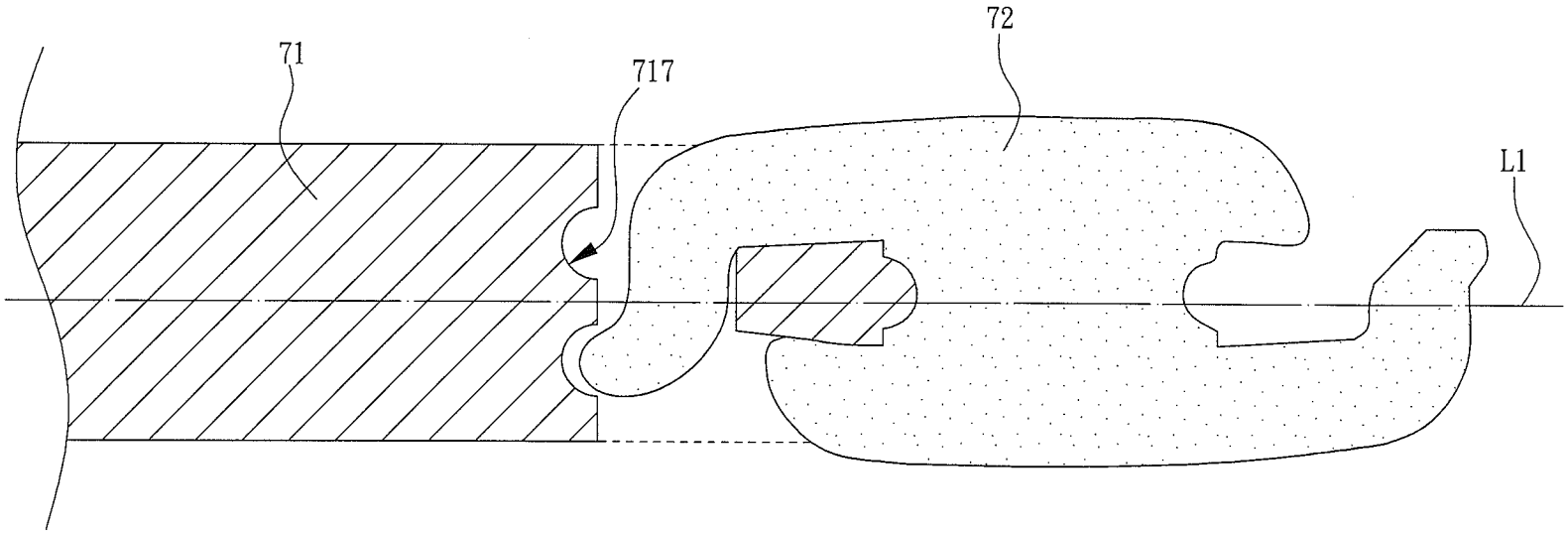
FIG. 8 is a cross sectional view showing a sixth embodiment of the present invention.

With reference to FIG. 8, in this embodiment, it is noted that the first abutting element 717 is composed of multiple recesses defined in a side face defining the coupling trough and the second abutting element formed at the distal end of the first arm of the coupler 72 is received in a selected one of the multiple recesses.

Figure 9:
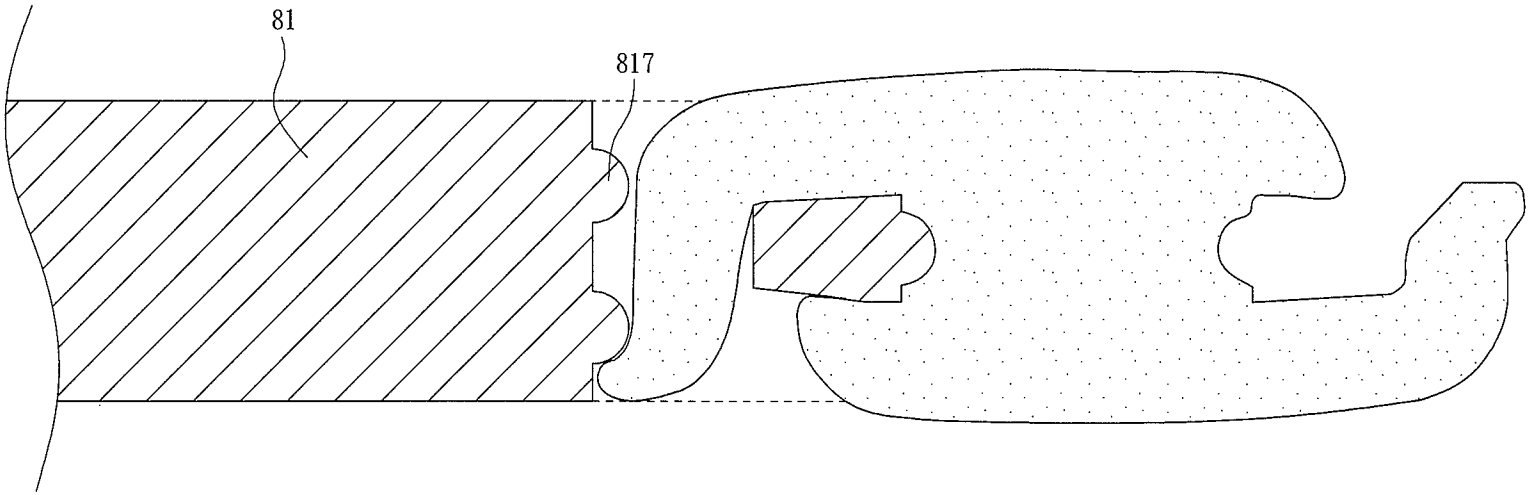
FIG. 9 is a cross sectional view showing a seventh embodiment of the present invention.

With reference to FIG. 9, the first abutting element 817 of the main board 81 is now composed of multiple bosses and the second abutting element formed at the distal end of the first arm is abutted against a bottom periphery of a selected one of the multiple bosses.

Figure 10:
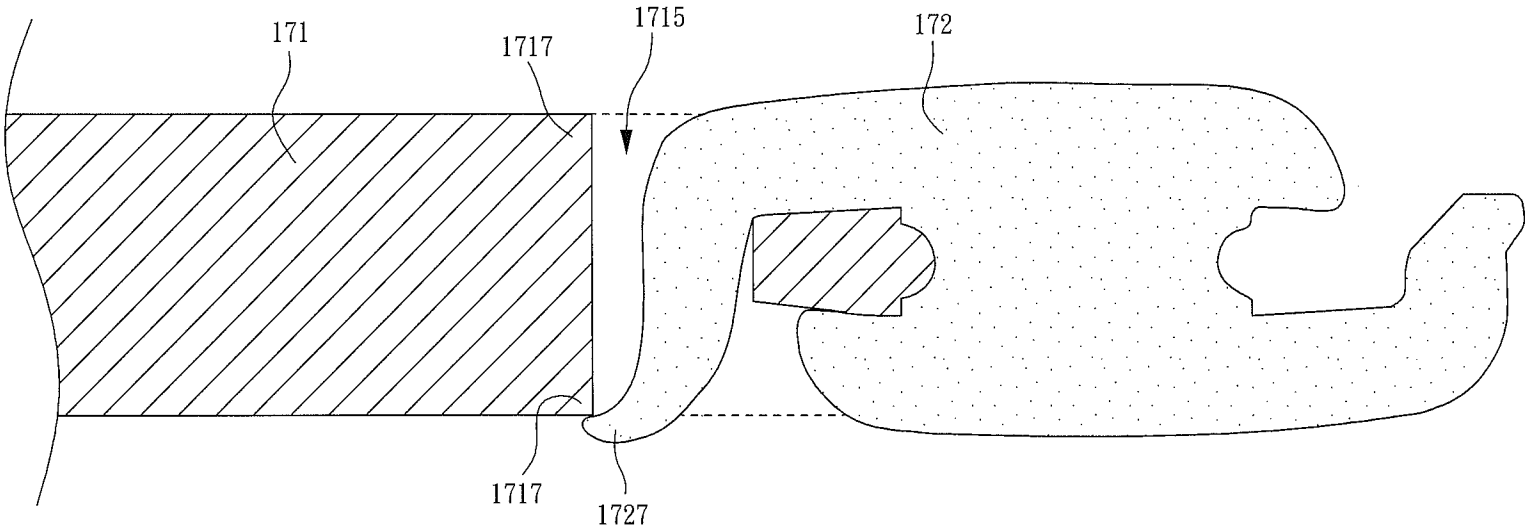
FIG. 10 is a cross sectional view showing an eighth embodiment of the present invention.

With reference to FIG. 10, it is noted that the first abutting element 1717 of the main board 171 is formed at a bottom face defining the coupling trough 1715 such that after the second abutting element 1727 of the coupler 172 extends into the coupling trough 1715, the second abutting element 1727, formed at the distal end of the first arm, abuts the bottom periphery of the first abutting element 1717 to secure the engagement between the main board 171 and the coupler 172.

Figure 11:
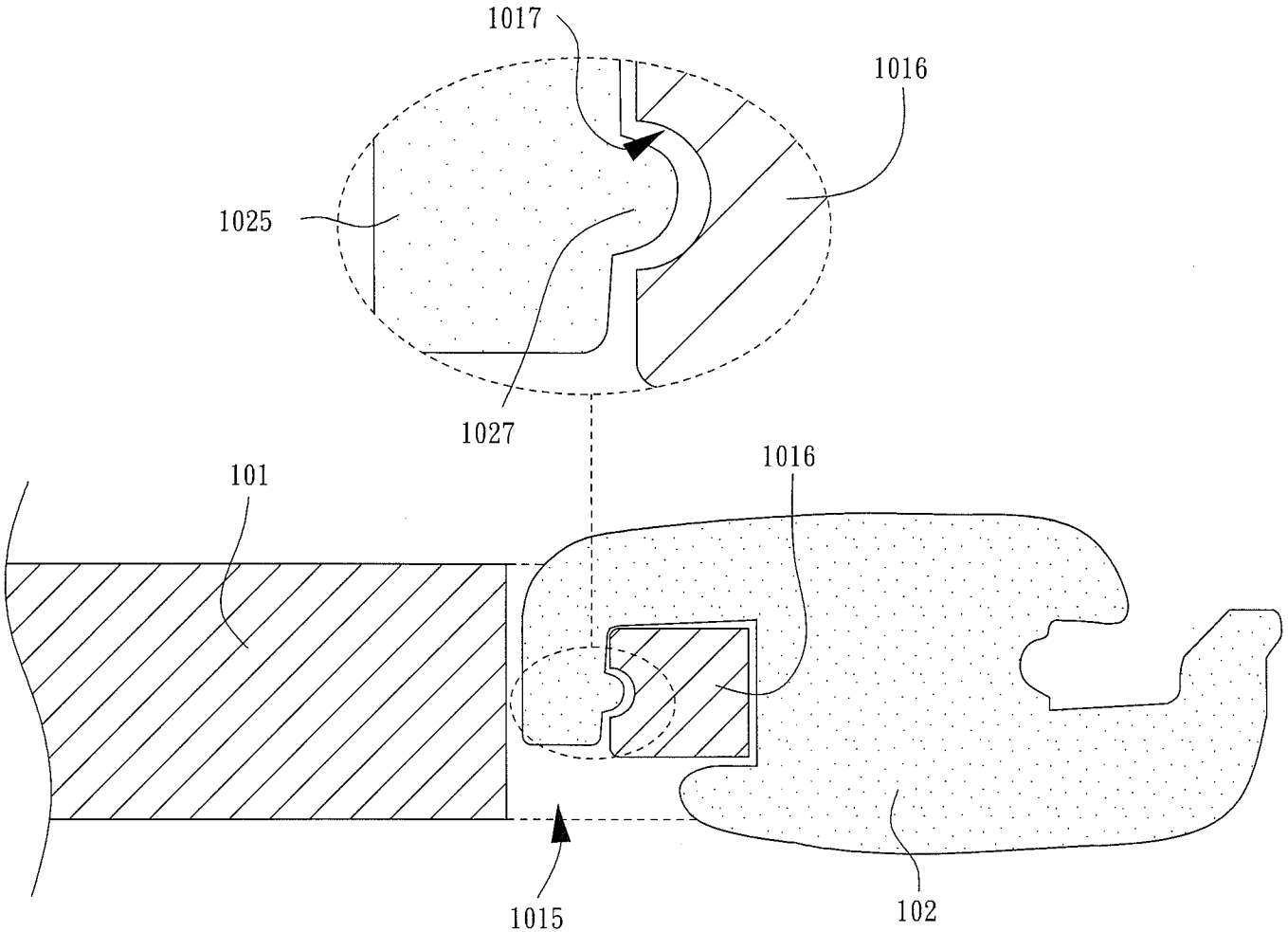
FIG. 11 is a cross sectional view showing a ninth embodiment of the present invention.

With reference to FIG. 11, it is noted that the at least one coupler 102 too has a first arm 1025 and a second abutting element 1027 formed at the distal end of the first arm 1025. The main board 101 too has a support beam 1016 and a first abutting element 1017 formed on a side face of the coupling trough 1015, wherein the first abutting element 1017 is now composed of a recess to receive therein the second abutting element 1027.

Figure 12:
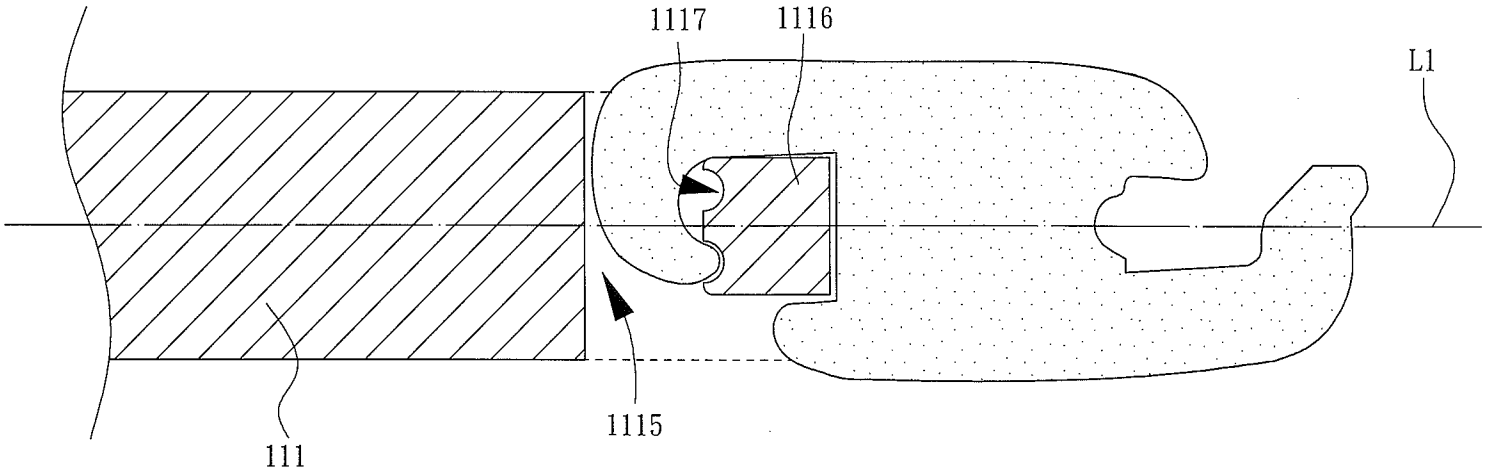
FIG. 12 is a cross sectional view showing a tenth embodiment of the present invention.

With reference to FIG. 12, it is noted that the main board 111 has a support beam 1116 and a first abutting element 1117 which is composed of multiple recesses, and the coupler has a second abutting element which is able to be received in one of the recesses.

Figure 13:
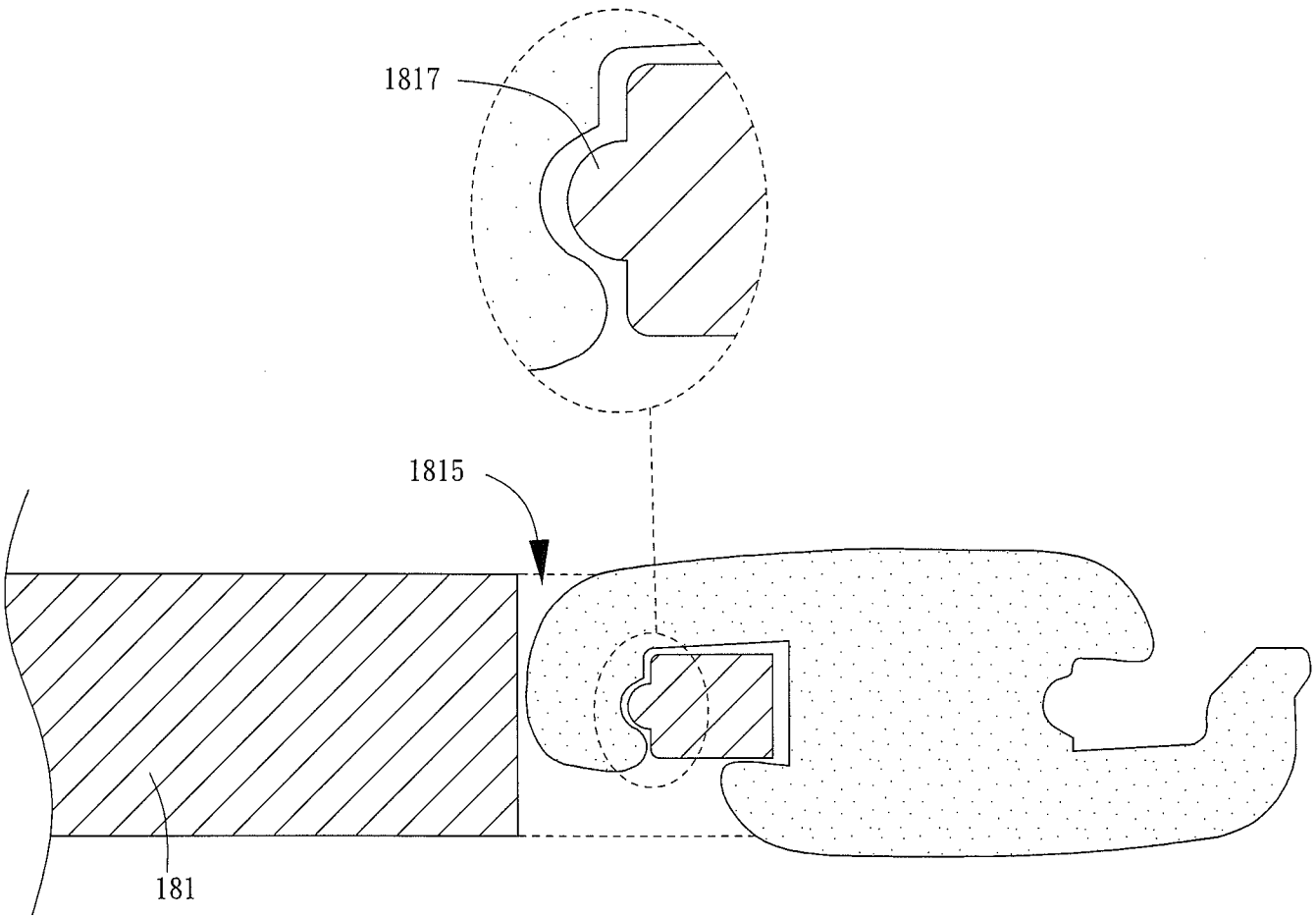
FIG. 13 is a cross sectional view showing an eleventh embodiment of the present invention.
Figure 14:
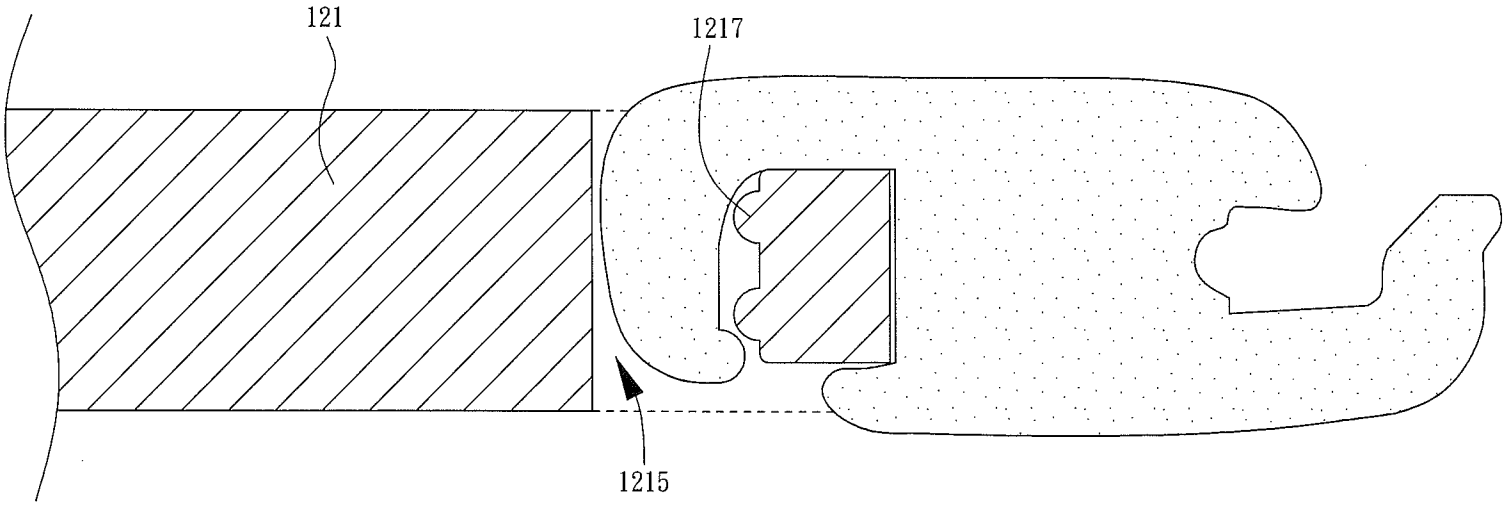
FIG. 14 is a cross sectional view showing a twelfth embodiment of the present invention.

With reference to FIGS. 13 and 14, it is noted that in these embodiments, the support beam of the main board 181, 121 has a first abutting element 1817, 1217 which is composed of a single or multiple bosses formed on a sidewall defining the coupling trough 1815, 1215 and a second abutting element of the first arm of the coupler is able to abut against a periphery of the single or one of the multiple bosses.

Figure 15:
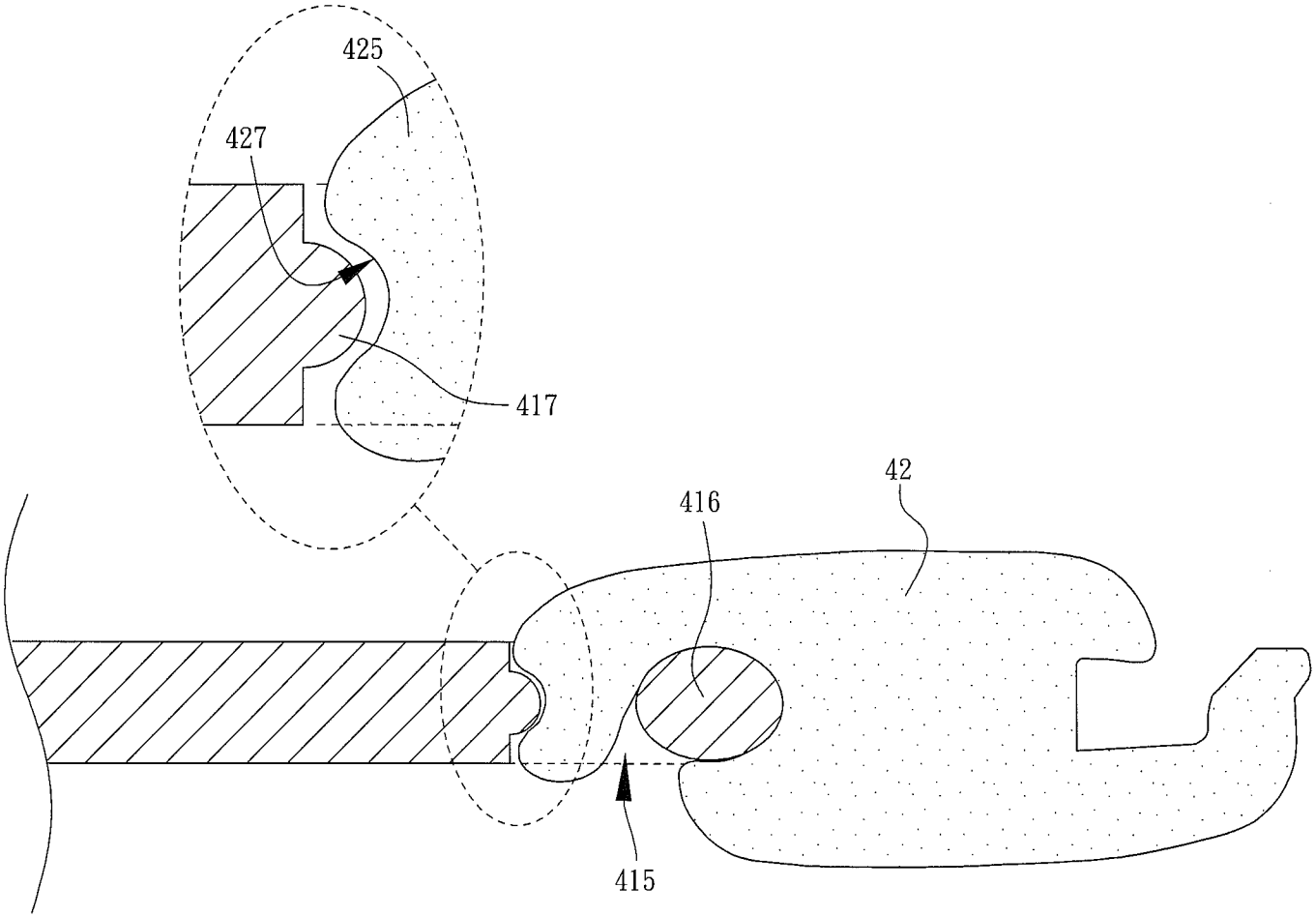
FIG. 15 is a cross sectional view showing a thirteenth embodiment of the present invention.

With reference to the embodiment shown in FIG. 15, it is noted that the second abutting element 427 formed at the distal end of the first arm 425 of the coupler 42 is composed of a recess to correspond to the first abutting element 417 formed on a side face defining the coupling trough 415 such that the first abutting element 417 is able to abut the second abutting element 427 of the coupler 42 to secure the engagement. It is also noted that in this preferred embodiment, the support beam 416 has a rounded cross section.

Figure 16:
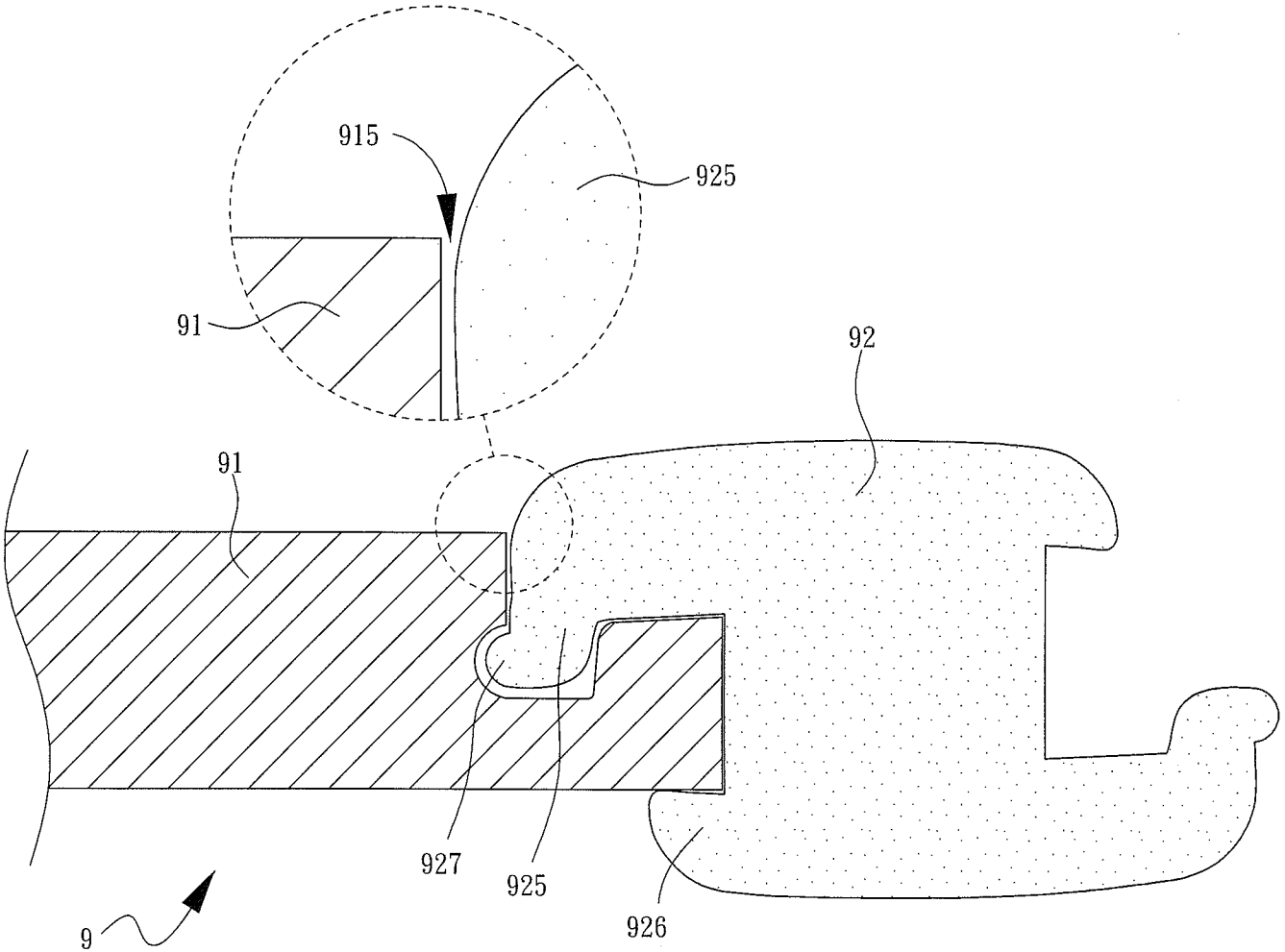
FIG. 16 is a cross sectional view showing a fourteenth embodiment of the present invention.

With reference to FIG. 16, in this embodiment it is to be noted that the coupling trough 915 is composed of a coupling recess defined between the main board 91 and the support beam (not numbered), and the first abutting element is composed of a cutout (not numbered) defined in a side face defining the coupling recess and communicating with the coupling recess to receive therein the second abutting element 927 formed at the distal end of the first arm 925 of the coupler 92, while the second arm 926 abuts a bottom face of the support beam.

Figure 17:
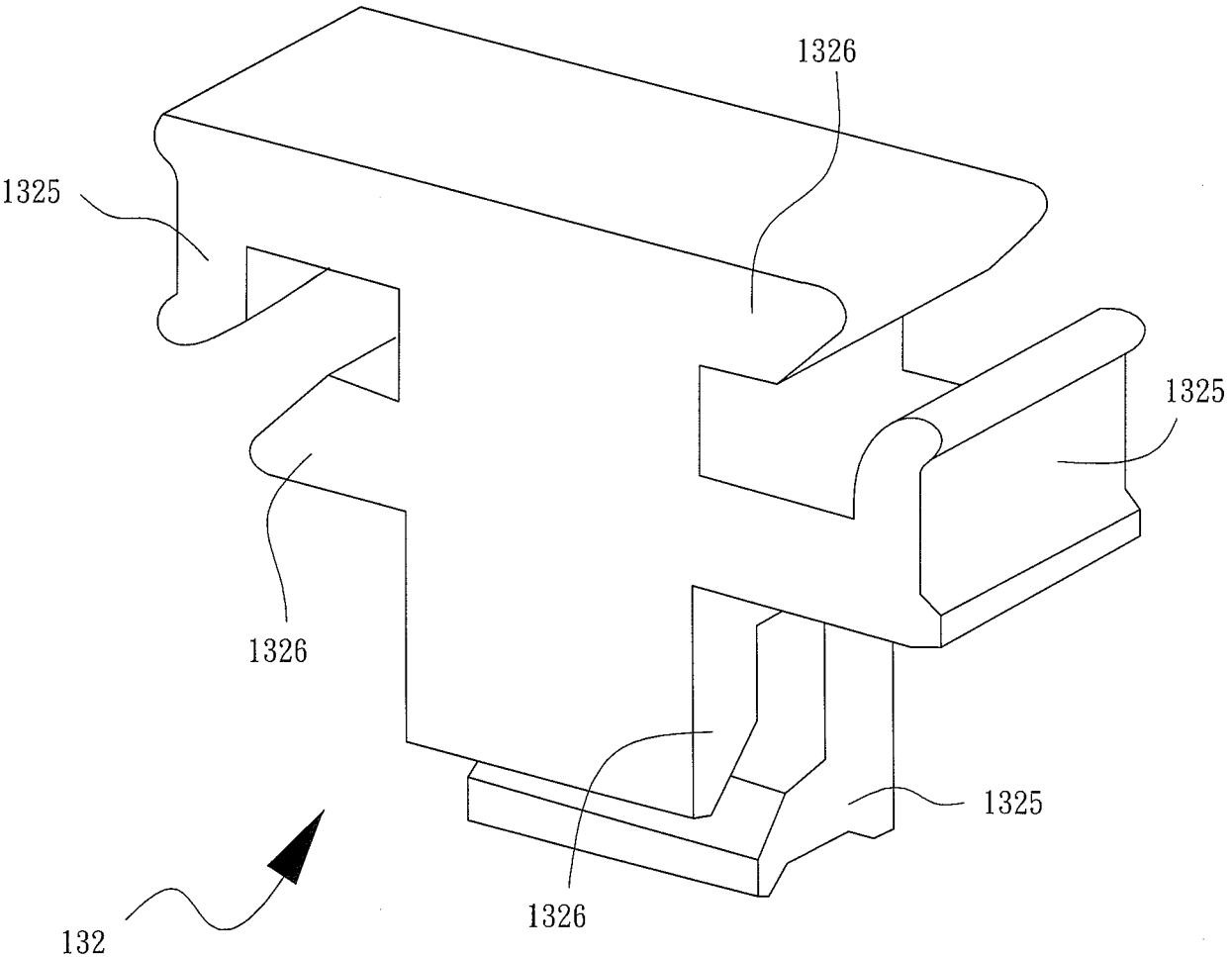
FIG. 17 is a perspective view showing the structure of a coupler of the present invention.

With reference to FIG. 17, it is noted that in this preferred embodiment, the at least one coupler 132 has a body, three first arms 1325 and three second arms 1326 respectively extending out from the body in a direction different from that of the first arms 1325 so as to define therebetween a receiving space (not numbered). It is also noted that in this preferred embodiment, the coupler 132 may be used to connect three main boards (not shown) to one another.

Figure 18:
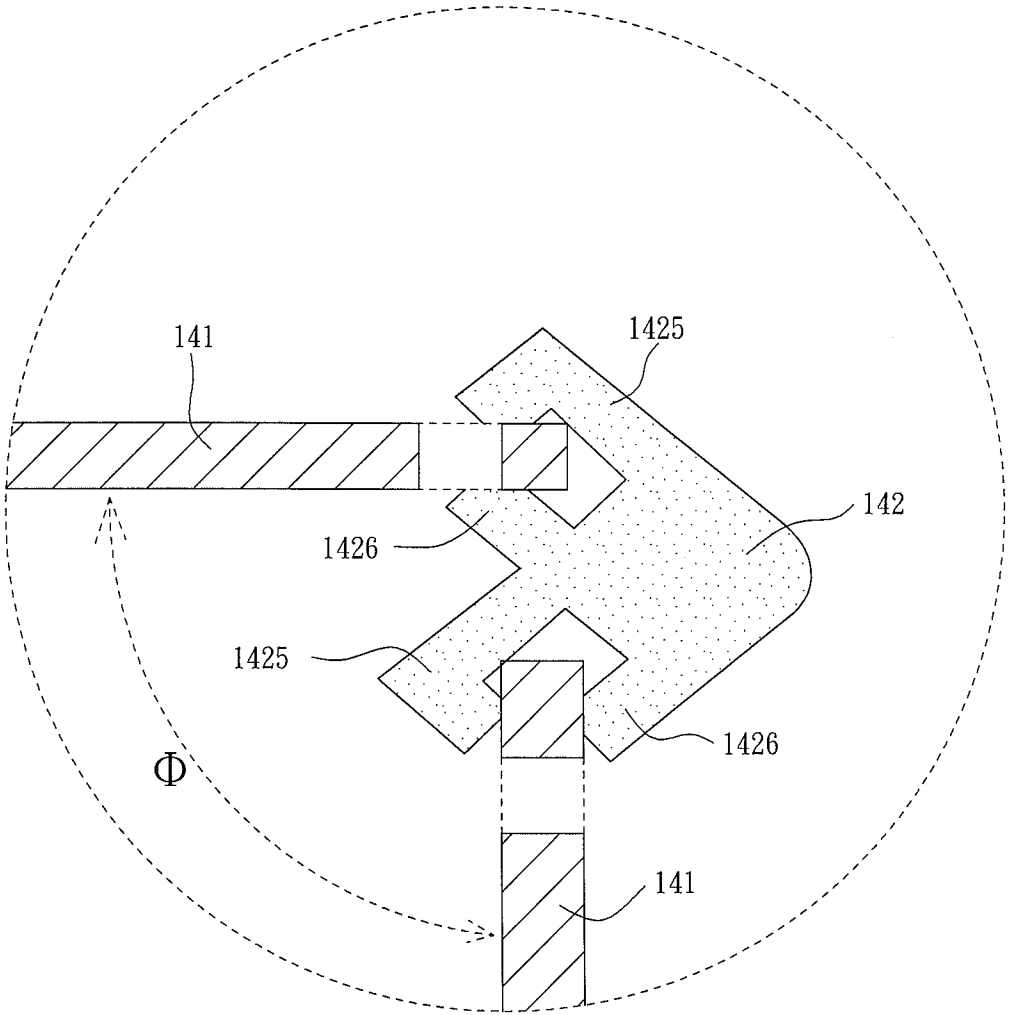
FIG. 18 is a schematic cross sectional view showing the connection between two main boards and a coupler.

With reference to FIG. 18, when two main boards 141 are to be connected to one another via the at least one coupler 142 having two first arms 1425 and two second arms 1426, a counterclockwise torque (not shown) is applied to rotate the coupler 142 such that the two first arms 1425 extend into the respective coupling troughs and the two second arms 1426 respectively engage with bottom faces of the support beams of the two main boards 141; the two main boards 141 are then connected and separated from each other by an angle Φ.

Figure 19:
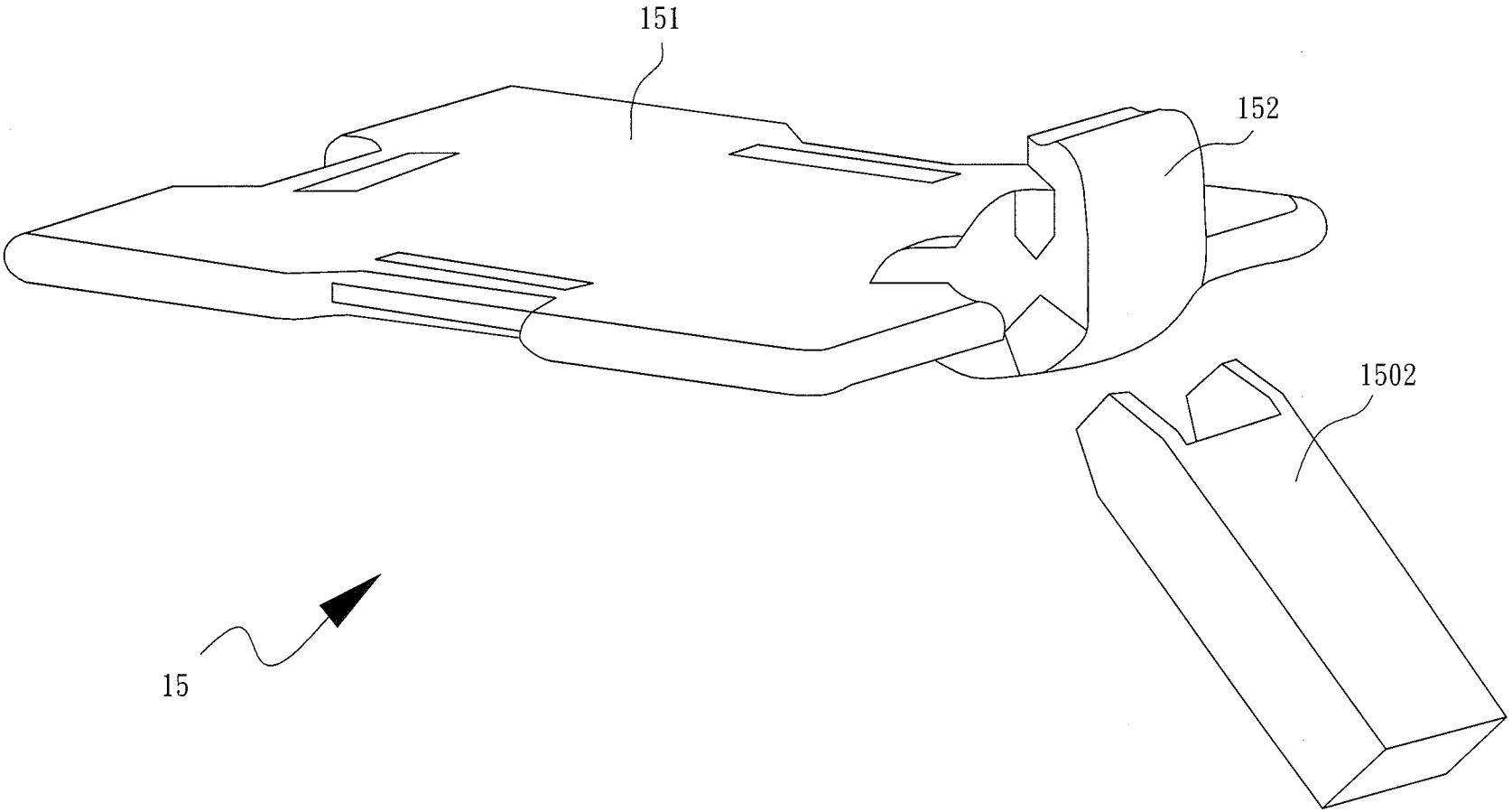
FIG. 19 is a perspective view showing an auxiliary element being applied to connect to a coupler of the present invention.

With reference to FIG. 19, the coupling structure 15 in this embodiment has a main board 151 and a coupler 152, which are connected substantially the same as a selected one of the previously introduced embodiments. However, the coupler 152 may additionally connect to an auxiliary object 1502 via any known connection methods.

Figure 20:
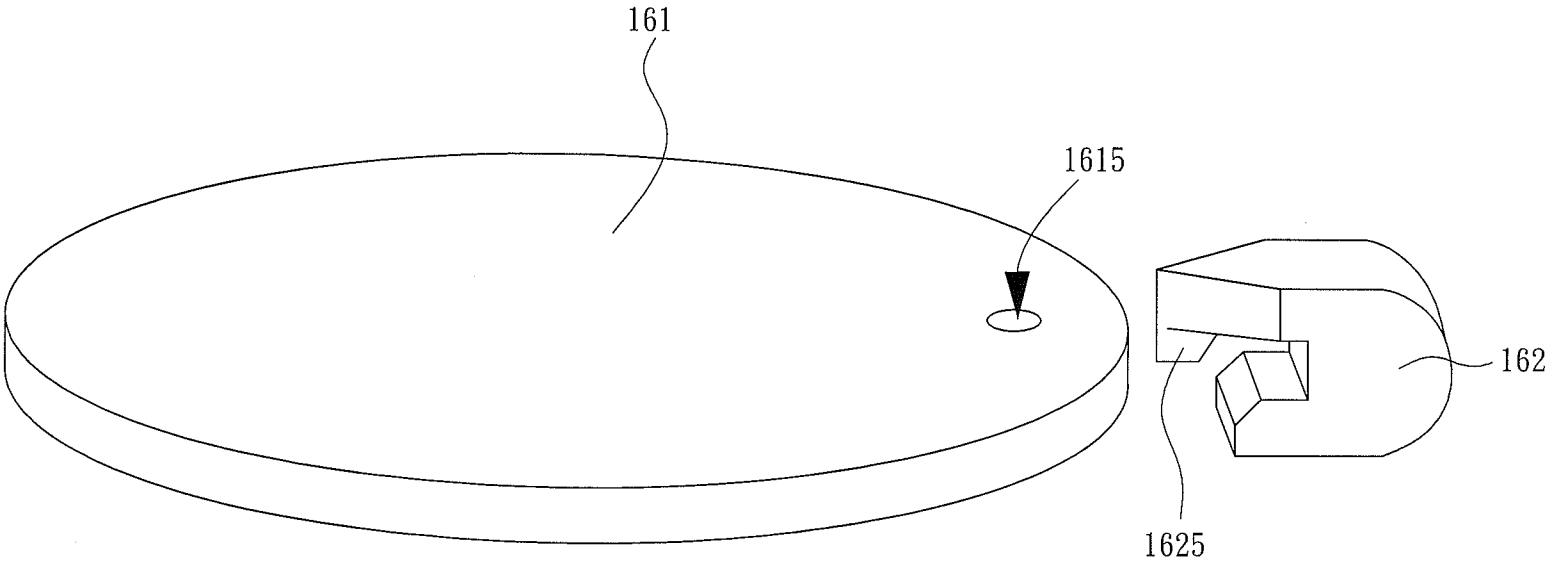
FIG. 20 is a perspective view showing still another embodiment of the present invention.

With reference to FIG. 20, it is noted that the main board 161 has a coupling trough 1615 which is composed of a round hole defined through the main board 161. The at least one coupler 162 has a second abutting element 1625 formed into a bar to correspond to the round through-hole of the main board 161.

While the invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. In a coupling structure having a main board and at least one coupler detachably connected to the main board, wherein the structure comprises:

the main board having at least one coupling trough defined therein, a first abutting element defined in a side face of the at least one coupling trough and a support beam formed adjacent to the at least one coupling trough;

the at least one coupler having at least one first arm and at least one second arm extending in a direction different from that of the at least one first arm so as to receivably contain therebetween the support beam, the at least one first arm having a second abutting element formed at a distal end of the at least one first arm to correspond to and abut a periphery of the first abutting element so that engagement between the main board and the at least one coupler is detachably secured; and the at least one first arm and the at least one second arm being located separately from one another and maintaining an open receiving space between the at least one first arm and the at least one second arm to receive therein the support beam during attachment, and to release therefrom the support beam during detachment.

2. The coupling structure as claimed in claim 1, wherein the first abutting element is composed of a boss formed on a sidewall defining the inner side of the at least one coupling trough and the second abutting element is composed of a protrusion formed at the distal end of the at least one first arm to correspond to and detachably abut a periphery of the boss.

3. The coupling structure as claimed in claim 1, wherein the main board further defines a first alignment element formed on a sidewall of the support beam to align with a second alignment element defined in a periphery of the receiving space when the support beam is received in the receiving space.

4. The coupling structure as claimed in claim 1, wherein the receiving space further has at least two opposite sidewalls that are made to conform to the top and bottom faces of the support beam.

5. The coupling structure as claimed in claim 1, wherein an outer sidewall of the support beam is thicker than an inner sidewall of the support beam.

6. The coupling structure as claimed in claim 1, wherein an outer sidewall of the support beam is thinner than an inner sidewall of the support beam.

7. The coupling structure as claimed in claim 1, wherein the support beam has a rounded cross section.

8. The coupling structure as claimed in claim 1, wherein the support beam has a thickness thinner than that of the main board.

9. The coupling structure as claimed in claim 1, wherein the at least one coupling trough is composed of a through-hole defined in the main board.

10. The coupling structure as claimed in claim 9, wherein the first abutting element is formed on a bottom face of a sidewall defining the through-hole and the second abutting element is composed of a protrusion formed at the distal end of the at least one first arm to correspond to and detachably abut the bottom face of the sidewall defining the through-hole.

11. The coupling structure as claimed in claim 1, wherein the at least one coupling trough is composed of a coupling recess defined between the main board and the support beam, and the first abutting element is composed of a cutout defined in a side face of the coupling recess.

12. The coupling structure as claimed in claim 1, wherein a longitudinal line is defined to divide the main board into two halves and the two halves of the main board are symmetrical to one another.

13. The coupling structure as claimed in claim 1, wherein the first abutting element is composed of multiple bosses formed on a sidewall defining the inner side of the at least one coupling trough and the second abutting element is composed of a protrusion formed at the distal end of the at least one first arm to correspond to and detachably abut a periphery of one of the bosses.

14. The coupling structure as claimed in claim 1, wherein the first abutting element is composed of a recess defined in a sidewall defining the inner side of the at least one coupling trough and the second abutting element is composed of a protrusion formed at the distal end of the at least one first arm to correspond to and be detachably received in the recess.

15. The coupling structure as claimed in claim 1, wherein the first abutting element is composed of multiple recesses defined in a sidewall defining the inner side of the at least one coupling trough and the second abutting element is composed of a protrusion formed at the distal end of the at least one first arm to correspond to and be detachably received in one of the recesses.

16. The coupling structure as claimed in claim 1, wherein the first abutting element is composed of a boss defined in a sidewall defining the inner side of the at least one coupling trough and the second abutting element is composed of a recess formed at the distal end of the at least one first arm to correspond to and detachably receive the boss.

17. The coupling structure as claimed in claim 1, wherein the first abutting element is composed of multiple bosses defined in a sidewall defining the inner side of the at least one coupling trough and the second abutting element is composed of a recess formed at the distal end of the at least one first arm to correspond to and detachably receive one of the bosses.

* * * * *